US005139995A

United States Patent [19]

Taki et al.

[11] Patent Number: 5,139,995

[45] Date of Patent: Aug. 18, 1992

[54] IMAGE RECEIVING SHEET FOR THERMAL TRANSFER RECORDING AND THERMAL TRANSFER RECORDING METHOD

[75] Inventors: Tsutomu Taki, Tokyo; Yukichi Murata, Sagamihara; Katsuhiko Kuroda, Yokohama, all of Japan

[73] Assignee: Mitsubishi Kasei Corporation, Tokyo, Japan

[21] Appl. No.: 561,329

[22] Filed: Aug. 1, 1990

[30] Foreign Application Priority Data

Aug. 3, 1989 [JP] Japan ..... 1-202070
Aug. 3, 1989 [JP] Japan ..... 1-202071
May 22, 1990 [JP] Japan ..... 2-132380

[51] Int. Cl.[5] ..... B41M 5/035; B41M 5/26

[52] U.S. Cl. ..... 503/227; 156/234; 428/195; 428/336; 428/480; 428/500; 428/913; 428/914

[58] Field of Search ..... 8/471; 428/195, 480, 428/913, 914, 500, 336; 503/227; 156/234

[56] References Cited

U.S. PATENT DOCUMENTS 4,731,355 3/1988 Iwasaki et al. ..... 503/227
4,829,050 5/1989 Henzel et al. ..... 503/227
4,902,670 2/1990 Kanto et al. ..... 503/227

OTHER PUBLICATIONS

Patent Abstracts of Japan, vol. 13, No. 10 (M-782) (3358) Jan. 11, 1989, and JP-A-63 221077 (Sedisui Chem Co Ltd) Sep. 14, 1988.

*Primary Examiner*—Bruce H. Hess

*Attorney, Agent, or Firm*—Oblon, Spivak, McClelland, Maier & Neustadt

[57] ABSTRACT

An image receiving sheet for thermal transfer recording, which comprises a substrate and an image receiving layer formed on the substrate, wherein the image receiving layer comprises, as the main component, a polyvinyl acetal resin of the following formula (I):

(I)

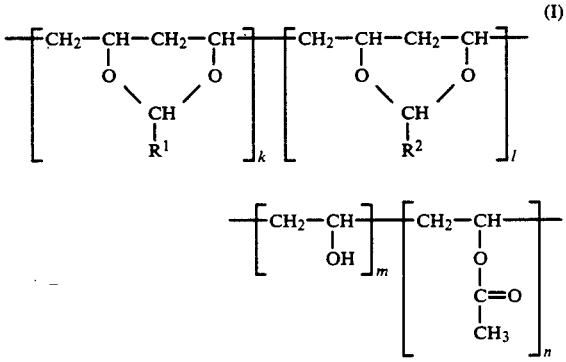

wherein k, l, m and n represent percentages of the respective structural units in the formula within ranges of $50<k+l<85$, $0\leqq k<85$, $0\leqq l<85$, $10<m<50$ and $0<n<30$, and $R^1$ and $R^2$ are different from each other and each represents a hydrogen atom, a substituted or unsubstituted alkyl group, an aryl group, an alkenyl group or a vinyl group substituted by an aryl group, provided that when $R^1$ is an unsubstituted alkyl group, $l\neq 0$.

13 Claims, No Drawings

IMAGE RECEIVING SHEET FOR THERMAL TRANSFER RECORDING AND THERMAL TRANSFER RECORDING METHOD

The present invention relates to an image receiving sheet for thermal transfer recording and a thermal transfer recording method using such an image receiving sheet.

In a colorant-transferring type thermal transfer recording in which a thermal transfer recording sheet comprising a base film and an ink layer composed mainly of a heat transferable colorant and a binder resin formed on one side of the base film, is heated by a heating means such as a thermal head to transfer the colorant to an image receiving sheet comprising a substrate and an image receiving layer composed mainly of a colorant receptive resin formed on the surface of the substrate, the image receiving sheet is required to have the following properties:

1) At the time of transfer recording, it does not fuse or stick to the transfer recording sheet, and after the recording, it can readily be released from the transfer recording sheet and provides records with excellent contrast.

2) Its image receiving layer provides high tinting strength of the colorant and makes high density recording possible, and after the recording, migration of the colorant scarcely takes place.

3) It provides excellent storage stability such as light resistance and discoloration resistance of the records.

For such properties of an image receiving sheet for thermal transfer recording, it is important to select the resin to be used for forming the image receiving layer. Various resins have been proposed, but none of them is fully satisfactory.

It is an object of the present invention to provide an image receiving sheet for color-transferring type thermal transfer recording, whereby the tinting strength of the colorant at the image receiving layer is excellent, high density recording is possible, migration of the colorant after the recording scarcely takes place, the storage stability such as the light resistance or the discoloration resistance of the records, is excellent.

The present invention provides an image receiving sheet for thermal transfer recording, which comprises a substrate and an image receiving layer formed on the substrate, wherein the image receiving layer comprises, as the main component, a polyvinyl acetal resin of the following formula (I):

(I)

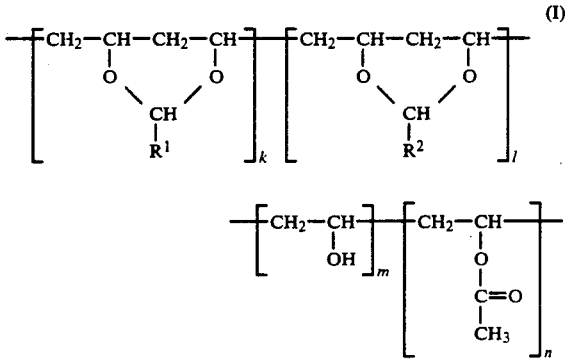

wherein k, l, m and n represent percentages of the respective structural units in the formula within ranges of $50<k+l<85$, $0\leqq k<85$, $0\leqq l<85$, $10<m<50$ and $0<n<30$, and $R^1$ and $R^2$ are different from each other and each represents a hydrogen atom, a substituted or unsubstituted alkyl group, an aryl group, an alkenyl group or a vinyl group substituted by an aryl group, provided that when $R^1$ is an unsubstituted alkyl group, $l\neq 0$.

Further, the present invention provides a thermal transfer recording method which comprises heating a thermal transfer recording sheet comprising a base film and an ink layer formed on the base film and comprising a heat transferable colorant and a binder, to transfer said colorant to an image receiving sheet for thermal transfer recording comprising a substrate and an image receiving layer formed on the substrate, wherein the image receiving layer comprises, as the main component, a polyvinyl acetal resin of the above formula (I).

The formula (I) and other similar structural formulas disclosed in this specification are intended merely to indicate the proportions of the respective elements constituting the resin, and they are by no means intended to specify the arrangements (such as block structures, etc.). Further, the polyvinyl acetal resin of the formula (I) may further contain a certain amount of other constituting elements, so long as the object of the present invention is not thereby lost.

Now, the present invention will be described in detail with reference to the preferred embodiments.

The polyvinyl acetal resin of the formula (I) to be used in the present invention, can be prepared by converting a polyvinyl alcohol to acetal with aldehydes of the formulas (II) and (III):

$$R^1\text{—CHO} \quad \text{(II)}$$

$$R^2\text{—CHO} \quad \text{(III)}$$

wherein $R^1$ and $R^2$ are as defined above with respect to the formula (I), by a conventional method.

Each of $R^1$ and $R^2$ in the formulas (I) to (III) may be a hydrogen atom; a linear or branched $C_1$–$C_{15}$ alkyl group; an aryl group such as a phenyl group or a naphthyl group; an alkenyl group such as a 2-methylvinyl group or a vinyl group; or a vinyl group substituted by an aryl group such as a phenyl group or a naphthyl group. The above alkyl group may be substituted by e.g. an aryl group, a halogen atom, an amino group or a carboxyl group. At least one of $R^1$ and $R^2$ is preferably an alkyl group substituted by an aryl group, a vinyl group substituted by an aryl group, or an aryl group. Such an aryl group may be the one having a substituent such as an alkyl group, an alkoxy group, an amino group, an alkylamino group, an acylamino group, a carboxyl group, a carboxylate group, a hydroxyl group or a halogen atom on an aromatic ring such as a benzene ring or a naphthalene ring. Preferred examples for $R^1$ and $R^2$ include a hydrogen atom, a $C_1$–$C_8$ alkyl group, a benzyl group, a 3-phenylpropyl group, a phenyl group, a naphthyl group, a tolyl group, a methoxyphenyl group, an ethylphenyl group, a chlorophenyl group, a 2-phenylvinyl group and a 1-n-hexyl-2-phenylvinyl group.

In the formula (I), k, l, m and n are $50<k+l<85$, $0\leqq k<85$, $0\leqq l<85$, $10<m<50$ and $0<n<30$, preferably $60<k+l<80$, $10<m<30$ and $1<n<25$. When $R^1$ is an unsubstituted alkyl group, $l\neq 0$.

The starting material polyvinyl alcohol preferably has a degree of polymerization of from 300 to 3,000 and may contain unsaponified acetyl groups to some extent.

However, the content is preferably not more than 30 mol %.

In the image receiving layer of the image receiving sheet of the present invention, the above-mentioned resins may be used alone or in combination in the form of a mixture. Although the image receiving layer of the present invention contains the above resin as the main component, it may further contain a saturated polyester resin, an acrylate resin, a methacrylate resin, a styrene resin, a polycarbonate resin, cellulose acetate, polyvinyl butylal, a vinyl chloride resin, a vinyl chloride/vinyl acetate copolymer resin, a polyarylate resin or an AS resin, as the case requires.

The image receiving layer preferably contain a releasing agent to prevent fusion of the transfer recording sheet and the image receiving sheet due to the heat during the thermal transfer recording and to improve the release properties of the two sheets after transfer recording. For this purpose, a silicone compound is used particularly preferably. However, various other types of releasing agents such as waxes, fluorinated compounds or fine particles may also be effectively used. To provide the release properties, a layer containing such a releasing agent may be formed on the image receiving layer. Further, the image receiving layer or the layer containing a releasing agent formed on the image receiving layer, may contain at least one compound selected from the group consisting of an ultraviolet absorber, a photostabilizer, an antioxidant, a fluorescent brightener and an antistatic agent.

As the substrate for the image receiving sheet, various papers made of cellulose fibers, various synthetic papers and plastic films made of synthetic resins and various laminates thereof may be used.

A method of forming the image receiving layer of the present invention may comprise dissolving the above-mentioned polyvinyl acetal resin in a proper solvent, adding a proper releasing agent, and further adding other resins and various additives, as the case requires, to prepare a coating solution, and coating the solution on the substrate, followed by drying.

As the solvent useful for the preparation of the coating solution, various organic solvents capable of providing good solubility to the polyvinyl acetal resin to be used in the present invention, may be employed. Specific examples include, alcohol solvents such as methanol, ethanol, propanol and butanol, cellosolve solvents such as methyl cellosolve, methyl cellosolve, and butyl cellosolve, aromatic solvents such as toluene and xylene, ketone solvents such as acetone, methyl ethyl ketone, methyl isobutyl ketone and cyclohexanone, ester solvents such as ethyl acetate and butyl acetate, halogenated solvents such as methylene chloride, trichloroethylene and chlorobenzene, ether solvents such as tetrahydrofuran and dioxane, and amide solvents such as dimethylformamide and N-methylpyrrolidone.

The coating method may be selected optionally from conventional methods. For example, methods using a reverse roll coater, a gravure coater, a rod coater, an air doctor coater and a die coater, may be employed (for the details, see "Coating Methods" editted by Yuji Harasaki and published by Maki Shoten in 1977). The thickness of the image receiving layer to be formed on the substrate is usually from 0.1 to 20 μm, preferably from 1 to 10 μm, as the dried coating layer.

The thermal transfer recording sheet to be used in combination with the image receiving sheet of the present invention, comprises a base film and an ink layer formed on the base film and comprising a heat transferable colorant and a binder resin as the main components. Such a sheet is preferably the one having the rear side of the base film treated for heat resistance or for lubricating properties. The base film may, for example, be a film made of e.g. polyethylene terephthalate, polyamide, polyaramide, polyimide or polycarbonate. Among them, a polyethylene terephthalate film is particularly preferred, since it is excellent in the strength and heat resistance. The thickness of such a film is preferably from 1 to 30 μm, more preferably from 2 to 15 μm.

The ink layer in the thermal transfer recording sheet of the present invention may be formed by a usual method. For example, in the case of a sublimation-type thermal transfer recording sheet, a sublimable dye and a heat resistant binder resin are dissolved or dispersed in a suitable solvent to form an ink, this ink is coated on a base film, followed by drying.

In the case of a melting-type thermal transfer recording sheet, a colorant such as a pigment or a dye is dissolved or dispersed in a heat-meltable substance, if necessary, using a solvent, to form an ink, and this ink is coated on a base film, followed by drying. As the heat transferable colorant to be used for the above sublimation-type thermal transfer recording sheet, various nonionic sublimable dyes of indoaniline type, azo type, anthraquinone type, nitro type, styryl type, naphthoquinone type, quinophthalone type, azomethine type, cumarine type and condensed polycyclic type, may be employed. As the binder resin, a polycarbonate, a polysulfone resin, a polyvinyl butylal resin or a polyarylate resin may be mentioned.

Coating of such an ink may be conducted by the same methods as described above with respect to the formation of the image receiving layer. The thickness of the ink layer is preferably from 0.1 to 5 μm as a dried layer thickness.

The thermal transfer recording can be conducted by a usual heating means such as a thermal head.

Now, the present invention will be described in further detail with reference to Examples. However, it should be understood that the present invention is by no means restricted by such specific Examples.

EXAMPLE 1

(a) Preparation of an image receiving sheet

Ten parts by weight of a polyvinyl acetal resin having the following structure:

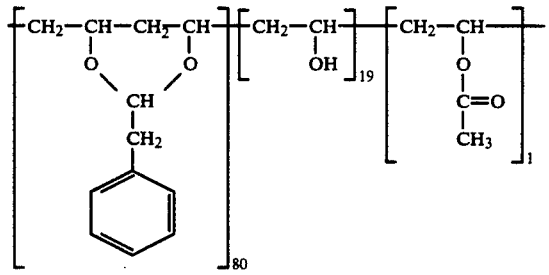

was dissolved in 15 parts by weight of methyl ethyl ketone and 15 parts by weight of toluene. To this solution, 0.5 part by weight of an amino-modified silicone "KF393" (tradename, manufactured by Shin-etsu Chemical Co., Ltd.) was added to prepare a coating solution for an image receiving layer. This coating solution was coated on a polypropylene synthetic paper having a thickness of 150 μm by a wire bar, followed by drying to form an image receiving layer having a dried layer thickness of about 5 μm. Thus, an image receiving sheet was prepared.

The above polyvinyl acetal resin was prepared by converting a polyvinyl alcohol (saponification degree: 99 mol %, polymerization degree: 1,700) to acetal with phenylacetoaldehyde.

(b) Preparation of a transfer recording sheet

On a biaxially stretched polyethylene terephthalate film (thickness: 6 μm) having the rear side of the ink-coating side treated for heat resistance and lubricating properties, an ink comprising 5 parts by weight of a magenta sublimable dye of the following structure (A), 10 parts by weight of a polycarbonate resin and 85 parts by weight of toluene, was coated and dried to form an ink layer having a dried layer thickness of about 1 μm. Thus, a transfer recording sheet was prepared.

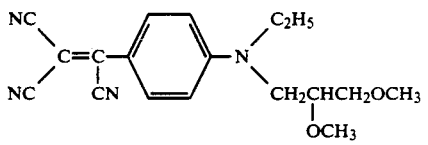

(A)

(c) Transfer recording test and storage stability test of the record (1) Transfer recording test The above transfer recording sheet and the image receiving sheet were put together so that the ink layer of the transfer recording sheet was in contact with the image receiving layer of the image receiving sheet, and recording was conducted under the following conditions using a thin film type line thermal head having a heat generating resister density of 8 dots/mm, to obtain a record with a color density as shown in the following Table 1.

Recording line density: 8 lines/mm
Electric power applied to the thermal head: 0.3 W/dot
Width of pulses applied to the thermal head: 6 msec (2) Storage stability test of the record The above record was exposed to irradiation for 20 hours by a Xenon fade meter, and the degree of discoloration after the exposure was measured by a color difference meter. The results are shown in the following Table 1.

Further, the above record was stored for 5 days at 60° C. under a relative humidity of 60%, whereupon the degree of the color blotting of the record was inspected by a microscope. The results are shown in Table 1.

EXAMPLE 2

The image receiving sheet and the transfer recording sheet were prepared, and the tests were conducted in the same manner as in Example 1 except that instead of the dye used in step (b) in Example 1, a yellow dye of the following structure (B) was used for the preparation of the transfer recording sheet, whereby the results as shown in Table 1 were obtained.

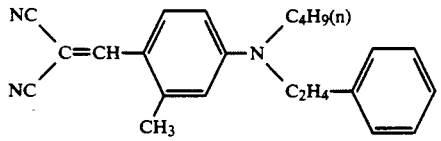

(B)

EXAMPLE 3

The image receiving sheet and the transfer recording sheet were prepared, and the tests were conducted in the same manner as in Example 1 except that instead of the dye used in step (b) in Example 1, a cyan dye of the following structure (C) was used for the preparation of the transfer recording sheet. The results are shown in Table 1.

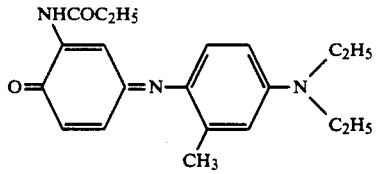

(C)

EXAMPLES 4 TO 6

The image receiving sheets and the transfer recording sheets were prepared, and the tests were conducted in the same manner as in Examples 1 to 3 except that instead of the polyvinyl acetal resin used in Examples 1 to 3, a polyvinyl acetal resin of the following structural formula:

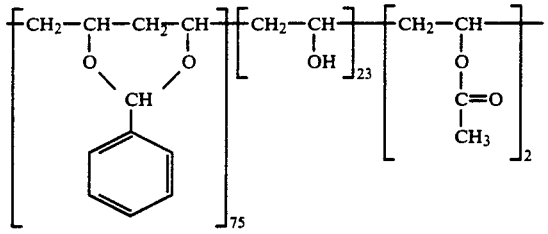

was used for the preparation of the image receiving sheet. The results are shown in Table 1.

The above polyvinyl butyral resin was prepared by converting a polyvinyl alcohol (saponification degree: 98 mol %, polymerization degree: 2,400) to acetal with benzaldehyde.

EXAMPLES 7 TO 9

The image receiving sheets and the transfer recording sheets were prepared, and the tests were conducted in the same manner as in Examples 1 to 3 except that instead of the polyvinyl acetal resin used in Examples 1 to 3, a polyvinyl acetal resin of the following structural formula:

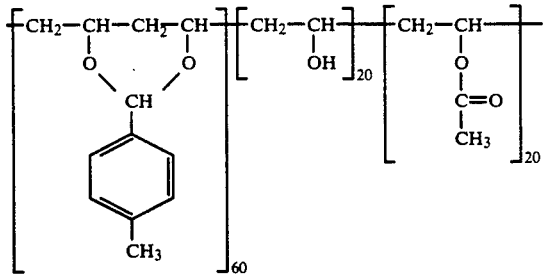

was used for the preparation of the image receiving sheet. The results are shown in Table 1.

The above polyvinyl butyral resin was prepared by converting a polyvinyl alcohol (saponification degree: 80 mol %, polymerization degree: 2,000) to acetal with p-toluene aldehyde.

EXAMPLES 10 TO 12

The image receiving sheets and the transfer recording sheets were prepared, and the tests were conducted in the same manner as in Examples 1 to 3 except that instead of the polyvinyl acetal resin used in Examples 1 to 3, a polyvinyl acetal resin of the following structural formula:

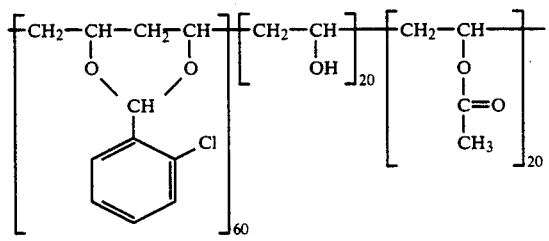

was used for the preparation of the image receiving sheet. The results are shown in the following Table 1.

The above polyvinyl butyral resin was prepared by converting a polyvinyl alcohol (saponification degree: 80 mol %, polymerization degree: 2,000) to acetal with o-chlorobenzaldehyde.

EXAMPLES 13 TO 15

The image receiving sheets and the transfer recording sheets were prepared, and the tests were conducted in the same manner as in Examples 1 to 3 except that instead of the polyvinyl acetal resin used in Examples 1 to 3, a polyvinyl acetal resin of the following structural formula:

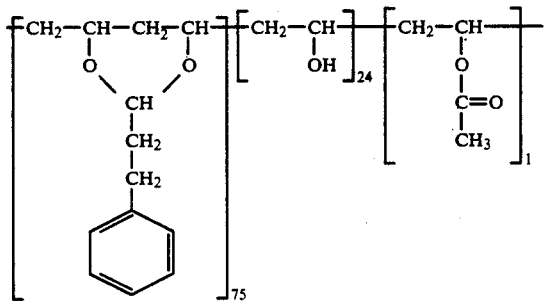

was used for the preparation of the image receiving sheets. The results are shown in Table 1 given hereinafter.

The above polyvinyl butyral resin was prepared by converting a polyvinyl alcohol (saponification degree: 99 mol %, polymerization degree: 1,700) to acetal with 3-phenylpropion aldehyde.

EXAMPLES 16 TO 18

The image receiving sheets and the transfer recording sheets were prepared, and the tests were conducted in the same manner as in Examples 1 to 3 except that instead of the polyvinyl acetal resin used in Examples 1 to 3, a polyvinyl acetal resin of the following structural formula:

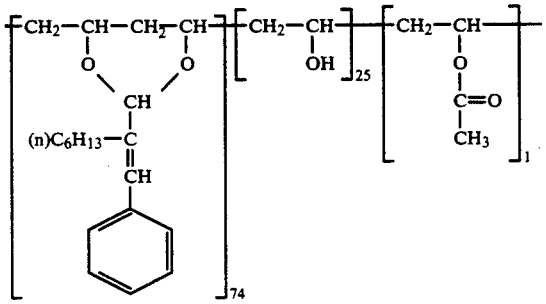

was used for the preparation of the image receiving sheets. The results are shown in Table 1 given hereinafter.

The above polyvinyl butyral resin was prepared by converting a polyvinyl alcohol (saponification degree: 99 mol %, polymerization degree: 1,700) to acetal with α-n-hexyl cinnamic aldehyde.

COMPARATIVE EXAMPLES 1 TO 3

Ten parts by weight of polyvinyl chloride (polymerization degree: 1,100, manufactured by Wako Junyaku Kogyo K.K.) was dissolved in 100 parts by weight of tetrahydrofuran, and to this solution, 0.5 part by weight of an amino-modified silicone "KF393" (tradename, manufactured by Shin-etsu Chemical Co., Ltd.) was added to prepare a coating solution. This coating solution was coated on a polypropylene synthetic paper having a thickness of 150 μm by a wire bar and dried to form an image receiving layer having a dried layer thickness of about 5 μm. Thus, an image receiving sheet was prepared. Each transfer recording sheet was prepared in the same manner as in Examples 1 to 3, and using the above image receiving sheet, tests were conducted in the same manner as in Examples 1, 2 and 3, respectively. The results are shown in Table 1 given hereinafter.

COMPARATIVE EXAMPLES 4 TO 6

The image receiving sheets and the transfer recording sheets were prepared, and the tests were conducted in the same manner as in Examples 1 to 3 except that instead of the AS resin used in Examples 1 to 3, a polyester resin (tradename: Byron 200, manufactured by Toyo Boseki K.K.) was used for the preparation of the image receiving sheets. The results are shown in Table 1 given hereinafter.

TABLE 1

| | Resin | Colorant | Color density of the record | Discloloration of the record after exposure (ΔE) | Color blotting of the record |
|---|---|---|---|---|---|
| Example 1 | Polyvinyl acetal | Magenta | 1.90 | 4.50 | Nil |
| Example 4 | Polyvinyl acetal | Magenta | 1.85 | 5.10 | Nil |
| Example 7 | Polyvinyl acetal | Magenta | 1.82 | 5.05 | Nil |
| Example 10 | Polyvinyl acetal | Magenta | 1.81 | 5.15 | Nil |
| Example 13 | Polyvinyl acetal | Magenta | 1.95 | 5.25 | Nil |
| Example 16 | Polyvinyl acetal | Magenta | 1.95 | 5.50 | Nil |
| Comparative Example 1 | Polyvinyl chloride | Magenta | 1.76 | 18.99 | Nil |
| Comparative Example 4 | Polyester | Magenta | 1.82 | 10.51 | Slightly |
| Example 2 | Polyvinyl acetal | Yellow | 1.87 | 3.65 | Nil |
| Example 5 | Polyvinyl acetal | Yellow | 1.85 | 4.15 | Nil |
| Example 8 | Polyvinyl acetal | Yellow | 1.83 | 4.05 | Nil |
| Example 11 | Polyvinyl acetal | Yellow | 1.82 | 4.25 | Nil |
| Example 14 | Polyvinyl acetal | Yellow | 1.90 | 4.15 | Nil |
| Example 17 | Polyvinyl acetal | Yellow | 1.88 | 4.35 | Nil |
| Comparative Example 2 | Polyvinyl chloride | Yellow | 1.62 | 9.56 | Nil |
| Comparative Example 5 | Polyester | Yellow | 1.81 | 7.65 | Slightly |
| Example 3 | Polyvinyl acetal | Cyan | 1.75 | 5.17 | Nil |
| Example 6 | Polyvinyl acetal | Cyan | 1.73 | 5.52 | Nil |
| Example 9 | Polyvinyl acetal | Cyan | 1.70 | 5.48 | Nil |
| Example 12 | Polyvinyl acetal | Cyan | 1.68 | 5.32 | Nil |
| Example 15 | Polyvinyl acetal | Cyan | 1.80 | 5.45 | Nil |
| Example 18 | Polyvinyl acetal | Cyan | 1.82 | 5.60 | Nil |
| Comparative Example 3 | Polyvinyl chloride | Cyan | 1.41 | 18.19 | Nil |
| Comparative Example 6 | Polyester | Cyan | 1.68 | 10.21 | Slightly |

EXAMPLE 19

The image receiving sheet and the transfer recording sheet were prepared, and the tests were conducted in the same manner as in Example 1 except that instead of the polyvinyl acetal resin used in Example 1, a polyvinyl acetal resin of the following structural formula:

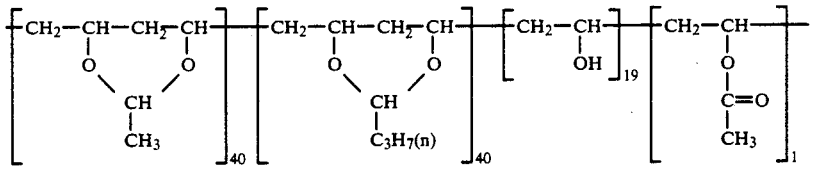

was used for the preparation of the image receiving sheet. The results are shown in Table 2 given hereinafter.

The above polyvinyl acetal resin was prepared by converting a polyvinyl alcohol (saponification degree: 99 mol %, polymerization degree: 2,400) to acetal with acetaldehyde and butylaldehyde.

EXAMPLES 20 TO 27

The image receiving sheets and the transfer recording sheets were prepared, and the tests were conducted in the same manner as in Example 19 except that instead of the polyvinyl acetal resin used in Example 19, the polyvinyl acetal resins as identified in Table 2 were used for the preparation of the image receiving sheets. The results are shown in Table 2.

The polyvinyl acetal resin used in each Example was prepared by converting a polyvinyl alcohol to acetal with the corresponding two types of aldehydes.

COMPARATIVE EXAMPLES 7 AND 8

The image receiving sheets and the transfer recording sheets were prepared, and the tests were conducted in the same manner as in Example 19 except that instead of the polyvinyl acetal resin used in Example 19, the polyvinyl acetal resins identified in Table 2 were used for the preparation of the image receiving sheets. The results are shown in Table 2.

The polyvinyl acetal resin used here was obtained by converting a polyvinyl alcohol to acetal with the corresponding type of aldehyde.

TABLE 2

| | Resin (formula I) | | | | | | | | | |
|---|---|---|---|---|---|---|---|---|---|---|
| | $R^1$ | $R^2$ | K | l | m | n | Polymerization degree | Color density of the record | Discloloration of the record after exposure (ΔE) | Color blotting of the record |
| Example 19 | $-CH_3$ | $-C_3H_7(n)$ | 40 | 40 | 19 | 1 | 2,400 | 1.95 | 5.50 | Nil |

TABLE 2-continued

| | Resin (formula I) | | | | | | | | | |
|---|---|---|---|---|---|---|---|---|---|---|
| | $R^1$ | $R^2$ | K | l | m | n | Polymerization degree | Color density of the record | Disclolor-ation of the record after exposure (ΔE) | Color blotting of the record |
| Example 20 | —H | $-CH(C_2H_5)C_4H_9(n)$ | 40 | 40 | 19 | 1 | 2,400 | 1.96 | 5.95 | Nil |
| Example 21 | $-CH_3$ | $-C_2H_5$ | 40 | 40 | 19 | 1 | 2,400 | 1.98 | 5.85 | Nil |
| Example 22 | $-CH_2=CH_2$ | $-C_3H_7(n)$ | 50 | 30 | 19 | 1 | 2,400 | 1.95 | 5.75 | Nil |
| Example 23 | 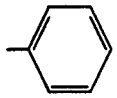 | $-C_3H_7(n)$ | 50 | 30 | 19 | 1 | 2,400 | 1.96 | 5.48 | Nil |
| Example 24 | 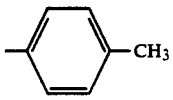 | $-C_3H_7(n)$ | 50 | 30 | 19 | 1 | 2,400 | 1.98 | 5.35 | Nil |
| Example 25 | 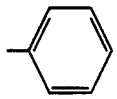 | $-C_3H_7(n)$ | 50 | 30 | 19 | 1 | 2,400 | 1.95 | 5.15 | Nil |
| Example 26 | 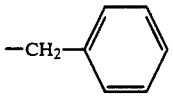 | $-C_3H_7(n)$ | 50 | 30 | 19 | 1 | 2,400 | 2.01 | 4.80 | Nil |
| Example 27 | $-CH_3$ | $-C_3H_7(n)$ | 30 | 30 | 20 | 20 | 20,000 | 1.89 | 5.50 | Nil |
| Comparative Example 7 | $-CH_3$ | — | 80 | — | 19 | 1 | 2,400 | 1.63 | 6.05 | Nil |
| Comparative Example 8 | $-C_3H_7(h)$ | — | 80 | — | 19 | 1 | 2,400 | 1.75 | 5.87 | Nil |

The image receiving sheet for thermal transfer recording of the present invention can readily be produced. When the image receiving sheet of the present invention is used as an image receiving sheet for thermal transfer recording, high density recording can be conducted to obtain a record having excellent storage stability such as light resistance and tinting properties.

Accordingly, it can advantageously be used for color recording at terminals of office appliances such as facsimile machines, printers and copy machines which are rapidly spreading in recent years, or for color recording of television images.

We claim:

1. An image receiving sheet for thermal transfer recording, which comprises a substrate and an image receiving layer formed on the substrate, wherein the image receiving layer comprises, as the main component, a polyvinyl acetal resin of the following formula (I):

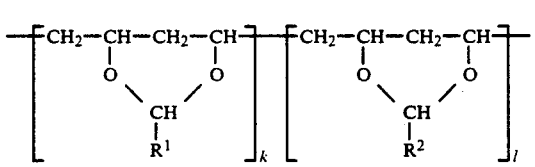

(I)

-continued

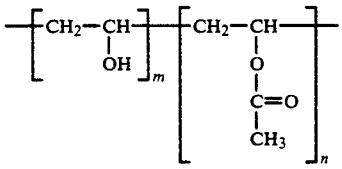

wherein k, l, m and n represent percentages of the respective structural units in the formula within ranges of $50<k+l<85$, $0\leqq k<85$, $0\leqq l<85$, $10<m<50$ and $0<n<30$, and $R^1$ and $R^2$ are different from each other and each represents a hydrogen atom, a substituted or unsubstituted alkyl group, an aryl group, an alkenyl group or a vinyl group substituted by an aryl group, provided that when $R^1$ is an unsubstituted alkyl group, $l\neq 0$.

2. The image receiving sheet according to claim 1, wherein in the formula (I), at least one of $R^1$ and $R^2$ is an alkyl group substituted by an aryl group, a vinyl group substituted by an aryl group, or an aryl group.

3. The image receiving sheet according to claim 1, wherein in the formula (I), k, l, m and n are within ranges of $60<k+l<84$, $10<m<30$, and $1<n<25$.

4. The image receiving sheet according to claim 1, wherein the polyvinyl acetal resin of the formula (I) is a resin obtained by converting a polyvinyl alcohol having a polymerization degree of from 300 to 3,000 to acetal.

5. The image receiving sheet according to claim 1, wherein the image receiving layer contains a releasing agent.

6. The image receiving sheet according to claim 1 or 5, wherein the image receiving layer contains at least one member selected from the group consisting of an ultraviolet absorber, a photostabilizer, an antioxidant, a fluorescent brightener and an antistatic agent.

7. The image receiving sheet according to claim 1, wherein the substrate is made of cellulose fiber and/or a synthetic resin.

8. The image receiving sheet according to claim 1, wherein the image receiving layer has a thickness of from 0.1 to 20 μm, and a backing layer is provided on the rear side of the substrate.

9. A thermal transfer recording method which comprises heating a thermal transfer recording sheet comprising a base film and an ink layer formed on the base film and comprising a heat transferable colorant and a binder, to transfer said colorant to an image receiving sheet for thermal transfer recording comprising a substrate and an image receiving layer formed on the substrate, wherein the image receiving layer comprises, as the main component, a polyvinyl acetal resin of the following formula (I):

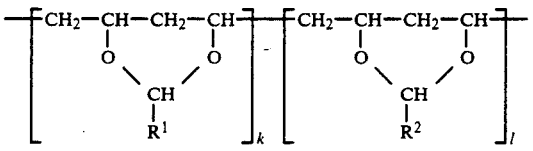

(I)

-continued

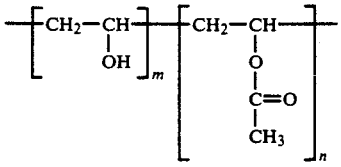

wherein k, l, m and represent percentages of the respective structural units in the formula within ranges of $50<k+l<85$, $0\leqq k<85$, $0\leqq l<85$, $10<m<50$ and $0<n<30$, and $R^1$ and $R^2$ are different from each other and each represents a hydrogen atom, a substituted or unsubstituted alkyl group, an aryl group, an alkenyl group or a vinyl group substituted by an aryl group, provided that when $R^1$ is an unsubstituted alkyl group, $l\neq 0$.

10. The thermal transfer recording method according to claim 9, wherein in the formula (I), at least one of $R^1$ and $R^2$ is an alkyl group substituted by an aryl group, a vinyl group substituted by an aryl group, or an aryl group.

11. The thermal transfer recording method according to claim 9, wherein the polyvinyl acetal resin of the formula (I) is a resin obtained by converting a polyvinyl alcohol having a polymerization degree of from 300 to 3,000 to acetal.

12. The thermal transfer recording method according to claim 9, wherein the image receiving layer contains a releasing agent.

13. The thermal transfer recording method according to claim 9, wherein the heat transferable colorant is at least one member selected from the group consisting of non-ionic dyes of indoaniline dyes, azo dyes, anthraquinone dyes, nitro dyes, styryl dyes, naphthoquinone dyes, quinophthalone dyes, azomethine dyes, cumarin dyes and condensed polycyclic dyes.

* * * * *